US011608551B2

(12) United States Patent
Lin et al.

(10) Patent No.: US 11,608,551 B2
(45) Date of Patent: Mar. 21, 2023

(54) ALUMINUM ALLOYS, AND METHODS FOR PRODUCING THE SAME

(71) Applicant: HOWMET AEROSPACE INC., Pittsburgh, PA (US)

(72) Inventors: Jen C. Lin, Export, PA (US); Gabriele F. Ciccola, Hudson, OH (US); Santosh Prasad, Murrysville, PA (US); Wei Wen, Allison Park, PA (US); Raymond J. Kilmer, Pittsburgh, PA (US)

(73) Assignee: Howmet Aerospace Inc., Pittsburgh, PA (US)

( * ) Notice: Subject to any disclaimer, the term of this patent is extended or adjusted under 35 U.S.C. 154(b) by 323 days.

(21) Appl. No.: 16/848,656

(22) Filed: Apr. 14, 2020

(65) Prior Publication Data

US 2020/0277691 A1 Sep. 3, 2020

Related U.S. Application Data

(63) Continuation of application No. PCT/US2018/058421, filed on Oct. 31, 2018.
(Continued)

(51) Int. Cl.
*C22F 1/057* (2006.01)
*C22C 21/02* (2006.01)
(Continued)

(52) U.S. Cl.
CPC ..... *C22F 1/057* (2013.01); *C22C 21/02* (2013.01); *C22C 21/10* (2013.01); *C22C 21/14* (2013.01);
(Continued)

(58) Field of Classification Search
CPC ..... C22F 1/002; C22F 1/043; C22F 1/053; C22F 1/057; C22C 21/02; C22C 21/08;
(Continued)

(56) References Cited

U.S. PATENT DOCUMENTS 5,888,320 A 3/1999 Dorward
6,132,531 A 10/2000 Fang et al.
6,317,913 B1 11/2001 Kilmer et al.
6,344,237 B1 2/2002 Kilmer et al.
(Continued)

FOREIGN PATENT DOCUMENTS

JP 10219381 A * 8/1998
JP H10-219381 8/1998
(Continued)

OTHER PUBLICATIONS

B. Raeisinia et al. "Examination of precipitation in the aluminum alloy AA6111 using electrical resistivity measurements" Materials Science and Engineering A 420 (2006) 245-249. (Year: 2006).*
(Continued)

*Primary Examiner* — Anthony J Zimmer
*Assistant Examiner* — Nazmun Nahar Shams
(74) *Attorney, Agent, or Firm* — Greenberg Traurig, LLP

(57) ABSTRACT

New aluminum alloys are disclosed and generally include 0.6-1.4 wt. % Si, 0.25-0.90 wt. % Mg, wherein the ratio of wt. % Si to wt. % Mg is from 1.05:1 to 5.0:1, 0.25-2.0 wt. % Cu, 0.10-3.5 wt. % Zn, 0.01-1.0 wt. % Fe, up to 0.8 wt. % Mn, up to 0.25 wt. % Cr, up to 0.20 wt. % Zr, up to 0.20 wt. % V, and up to 0.15 wt. % Ti, wherein the total of Fe+Mn+Cr+Zr+V+Ti is not greater than 2.0 wt. %, the balance being aluminum and impurities. The new aluminum alloys may include Q phase precipitates. In some embodiments, the solvus temperature of the Q phase precipitates is not greater than 950° F.

13 Claims, 2 Drawing Sheets

Related U.S. Application Data

(60) Provisional application No. 62/715,163, filed on Aug. 6, 2018, provisional application No. 62/579,728, filed on Oct. 31, 2017.

(51) Int. Cl.

| | |
|---|---|
| ***C22C 21/10*** | (2006.01) |
| ***C22C 21/14*** | (2006.01) |
| ***C22C 21/16*** | (2006.01) |
| ***C22C 21/18*** | (2006.01) |
| ***C22F 1/043*** | (2006.01) |
| ***C22F 1/053*** | (2006.01) |

(52) U.S. Cl.
CPC ..... *C22C 21/16* (2013.01); *C22C 21/18* (2013.01); *C22F 1/043* (2013.01); *C22F 1/053* (2013.01)

(58) Field of Classification Search
CPC ..... C22C 21/10; C22C 21/14; C22C 21/16; C22C 21/18
See application file for complete search history.

(56) References Cited

U.S. PATENT DOCUMENTS

| | | | |
|---|---|---|---|
| 6,528,183 | B2 | 3/2003 | Dif et al. |
| 6,555,251 | B2 | 4/2003 | Kilmer |
| 6,705,384 | B2 | 3/2004 | Kilmer et al. |
| 6,733,566 | B1 | 5/2004 | Fang et al. |
| 6,773,666 | B2 | 8/2004 | Lin et al. |
| 6,783,730 | B2 | 8/2004 | Lin et al. |
| 6,925,711 | B2 | 8/2005 | Kilmer et al. |
| 6,939,416 | B2 | 9/2005 | Benedictus et al. |
| 7,087,125 | B2 | 8/2006 | Lin et al. |
| 7,255,932 | B1 | 8/2007 | Kilmer |
| 7,337,941 | B2 | 3/2008 | Scott et al. |
| 7,374,827 | B2 | 5/2008 | Kilmer |
| 7,449,073 | B2 | 11/2008 | Lin et al. |
| 7,625,454 | B2 | 12/2009 | Lin et al. |
| 7,732,059 | B2 | 6/2010 | Ren et al. |
| 8,157,932 | B2 | 4/2012 | Yan et al. |
| 8,273,196 | B2 | 9/2012 | Hibino et al. |
| 8,287,668 | B2 | 10/2012 | Lin et al. |
| 8,349,462 | B2 | 1/2013 | Lin et al. |
| 8,366,846 | B2 | 2/2013 | Tataki et al. |
| 8,840,737 | B2 | 9/2014 | Bray et al. |
| 8,845,827 | B2 | 9/2014 | Yanar et al. |
| 8,986,850 | B2 | 3/2015 | Baumann et al. |
| 8,999,079 | B2 | 4/2015 | Kamat et al. |
| 9,194,028 | B2 | 11/2015 | Kamat et al. |
| 9,249,484 | B2 | 2/2016 | Kamat et al. |
| 9,249,487 | B2 | 2/2016 | Yan et al. |
| 9,315,885 | B2 | 4/2016 | Lin |
| 9,359,660 | B2 | 6/2016 | Kamat et al. |
| 9,458,528 | B2 | 10/2016 | Boselli et al. |
| 9,587,298 | B2 | 3/2017 | Lin et al. |
| 9,718,738 | B2 | 8/2017 | Iwig et al. |
| 9,856,552 | B2 | 1/2018 | Sawtell et al. |
| 9,890,443 | B2 | 2/2018 | Lin et al. |
| 9,926,620 | B2 | 3/2018 | Kamat et al. |
| 10,006,108 | B2 | 6/2018 | Wen et al. |
| 10,119,183 | B2 | 11/2018 | Lin et al. |
| 10,161,021 | B2 | 12/2018 | Lin et al. |
| 10,174,409 | B2 | 1/2019 | Yan et al. |
| 10,202,673 | B2 | 2/2019 | Lin et al. |
| 10,227,679 | B2 | 3/2019 | Yan et al. |
| 10,385,432 | B2 | 8/2019 | Kilmer et al. |
| 10,494,702 | B2 | 12/2019 | Kim et al. |
| 10,538,834 | B2 | 1/2020 | Wen et al. |
| 10,589,327 | B2 | 3/2020 | Stewart et al. |
| 10,704,128 | B2 | 7/2020 | Das et al. |
| 11,103,919 | B2 | 8/2021 | Yan et al. |
| 2003/0087122 | A1 | 5/2003 | Benedictus et al. |
| 2004/0086417 | A1 | 5/2004 | Baumann et al. |
| 2005/0095447 | A1 | 5/2005 | Baumann et al. |
| 2005/0167012 | A1 | 8/2005 | Lin et al. |
| 2005/0238528 | A1 | 10/2005 | Lin et al. |
| 2006/0078728 | A1 | 4/2006 | Kilmer |
| 2006/0289093 | A1 | 12/2006 | Yan et al. |
| 2007/0125460 | A1 | 6/2007 | Lin et al. |
| 2008/0066833 | A1 | 3/2008 | Lin et al. |
| 2008/0274367 | A1 | 11/2008 | Kilmer et al. |
| 2010/0047113 | A1 | 2/2010 | Lin et al. |
| 2010/0089503 | A1 | 4/2010 | Inagaki et al. |
| 2010/0129683 | A1 | 5/2010 | Lin et al. |
| 2010/0276108 | A1 | 11/2010 | Stol et al. |
| 2010/0304175 | A1 | 12/2010 | Kilmer et al. |
| 2011/0247736 | A1 | 10/2011 | Morita et al. |
| 2012/0055590 | A1 | 3/2012 | Kamat et al. |
| 2012/0156089 | A1 | 6/2012 | Gejima |
| 2014/0166165 | A1 | 6/2014 | Shibata |
| 2014/0230974 | A1 | 8/2014 | Lin et al. |
| 2014/0366997 | A1 | 12/2014 | Kamat et al. |
| 2014/0366998 | A1 | 12/2014 | Kamat et al. |
| 2014/0367000 | A1 | 12/2014 | Kamat et al. |
| 2015/0020930 | A1 | 1/2015 | Kamat et al. |
| 2015/0217599 | A1 | 8/2015 | Zehnder et al. |
| 2016/0107265 | A1 | 4/2016 | Lin et al. |
| 2016/0160333 | A1 | 6/2016 | Hosch et al. |
| 2017/0009325 | A1 | 1/2017 | Wyatt-Mair et al. |
| 2017/0014937 | A1 | 1/2017 | Wilhelmy et al. |
| 2017/0088920 | A1 | 3/2017 | Boselli et al. |
| 2017/0120386 | A1 | 5/2017 | Lin et al. |
| 2017/0120393 | A1 | 5/2017 | Lin et al. |
| 2017/0121795 | A1 | 5/2017 | Yan et al. |
| 2017/0175239 | A1 | 6/2017 | Ahmed et al. |
| 2017/0175240 | A1 | 6/2017 | Wen et al. |
| 2017/0292174 | A1 | 10/2017 | Karabin et al. |
| 2017/0306447 | A1 | 10/2017 | Lin et al. |
| 2017/0306448 | A1 | 10/2017 | Lin et al. |
| 2017/0306449 | A1 | 10/2017 | Lin et al. |
| 2017/0306450 | A1 | 10/2017 | Lin et al. |
| 2017/0306457 | A1 | 10/2017 | Lin et al. |
| 2017/0306460 | A1 | 10/2017 | Lin et al. |
| 2017/0314112 | A1 | 11/2017 | Go et al. |
| 2017/0326690 | A1 | 11/2017 | Heard et al. |
| 2017/0326868 | A1 | 11/2017 | Heard et al. |
| 2017/0369978 | A1 | 12/2017 | Kang et al. |
| 2018/0171438 | A1 | 6/2018 | Yan et al. |
| 2018/0179621 | A1 | 6/2018 | Muller et al. |
| 2018/0200834 | A1 | 7/2018 | Kilmer et al. |
| 2019/0193149 | A1 | 6/2019 | Kilmer et al. |
| 2019/0193158 | A1 | 6/2019 | Wilhelmy et al. |
| 2019/0309402 | A1 | 10/2019 | Karabin et al. |
| 2019/0357647 | A1 | 11/2019 | Kilmer et al. |
| 2020/0056268 | A1 | 2/2020 | Heard et al. |
| 2020/0080182 | A1 | 3/2020 | Ahmed et al. |
| 2020/0115780 | A1 | 4/2020 | Boselli et al. |
| 2020/0189314 | A1 | 6/2020 | Zehnder et al. |

FOREIGN PATENT DOCUMENTS

| | | | |
|---|---|---|---|
| JP | H11-310841 | 11/1999 | |
| JP | 2001-020027 | 1/2001 | |
| JP | 2001262264 | 9/2001 | |
| JP | 2002-371333 | 12/2002 | |
| JP | 2003-089859 | 3/2003 | |
| JP | 2011-252212 | 12/2011 | |
| WO | WO2005/075692 | 8/2005 | |
| WO | WO-2015146654 A1 * | 10/2015 | ..... B21J 5/00 |
| WO | WO2018/157159 | 8/2018 | |
| WO | WO2018/191111 | 10/2018 | |
| WO | WO2018/048785 | 3/2019 | |
| WO | WO2019/055623 | 3/2019 | |
| WO | WO2019/055630 | 3/2019 | |
| WO | WO2019/084045 | 5/2019 | |

OTHER PUBLICATIONS

WO2015146654A1, online machine translation (Year: 2015).*
JPH10219381A, online machine translation (Year: 1998).*

(56) References Cited

OTHER PUBLICATIONS

ASTM F2792-12a, "Standard Terminology for Additive Manufacturing Technologies" ASTM International, 2014.
ANSI H35.1, "American National Standard Alloy and Temper Designation Systems for Aluminum" The Aluminum Association Inc., 2009.
International Search Report and Written Opinion, dated Feb. 15, 2019, from corresponding International Patent App. No. PCT/US2018/058421.
Liang, W. J., et al., "General aspects related to the corrosion of 6xxx series aluminium alloys: exploring the influence of Mg/Si ratio and Cu" Corrosion Science 76:119-128, 2013.

* cited by examiner

ALUMINUM ALLOYS, AND METHODS FOR PRODUCING THE SAME

CROSS-REFERENCE TO RELATED APPLICATION

This application is a continuation of International Patent Application No. PCT/US2018/058421, filed Oct. 31, 2018, which claims the benefit of priority of U.S. Patent Application No. 62/579,728, filed Oct. 31, 2017, and U.S. Patent Application No. 62/715,163, filed Aug. 6, 2018, each of which is incorporated herein by reference in its entirety.

BACKGROUND

Aluminum alloys are useful in a variety of applications. However, improving one property of an aluminum alloy without degrading another property is elusive. For example, it is difficult to increase the strength of an alloy without decreasing the toughness of an alloy. Other properties of interest for aluminum alloys include corrosion resistance and fatigue resistance, to name two.

SUMMARY OF THE DISCLOSURE

Broadly, the present patent application relates to new aluminum alloys, and methods for producing the same. Generally, the new aluminum alloy products are press-quenchable, where solution heat treatment after hot working is not required to achieve final properties. Thus, methods of producing the aluminum alloys may be absent of any solution heat treatment step after the final hot working step. As used herein, solution heat treatment includes quenching.

The new aluminum alloys may be produced in wrought form, such as an in rolled form (e.g., as sheet or plate), as an extrusion, or as a forging, among others. In one embodiment, the new aluminum alloy is in the form of a forged wheel product (e.g., a press-quenched forged wheel product). In one embodiment, the forged wheel product is a die-forged wheel product. In one embodiment, the new aluminum alloy is in the form of an extruded product (e.g., a press-quenched extruded product). In one embodiment, a new aluminum alloy product realizes a pitting only rating, or "P" rating, or better, when tested in accordance with ASTM G110. In one embodiment, a new aluminum alloy product has good intergranular (IG) corrosion resistance, realizing a maximum depth of attack of not greater than 500 microns when tested in accordance with ASTM G110.

I. Composition

The new aluminum alloys generally comprise (and some instances consist essentially of, or consist of) silicon (Si), magnesium (Mg), copper (Cu), zinc (Zn), and iron (Fe), optionally with one or more of manganese (Mn), chromium (Cr), vanadium (V), zirconium (Zr), and titanium (Ti), the balance being aluminum and impurities. The new aluminum alloys generally include Q phase precipitates, and the solvus temperature of these Q phase precipitates is generally not greater than 950° F.

The new aluminum alloys generally include from 0.6 to 1.4 wt. % Si, from 0.25 to 0.90 wt. % Mg, where the ratio of wt. % Si to wt. % Mg is from 1.05:1 to 5.0:1, from 0.25 to 2.0 wt. % Cu, from 0.10 to 3.5 wt. % Zn, and from 0.01 to 1.0 wt. % Fe. The new aluminum alloys may optionally include up to 0.8 wt. % Mn, up to 0.25 wt. % Cr, up to 0.20 wt. % Zr, up to 0.20 wt. % V, and up to 0.15 wt. % Ti. The total content of Fe+Mn+Cr+Zr+V+Ti within the new aluminum alloys is generally not greater than 2.0 wt. %.

As noted above, the new aluminum alloys generally include silicon and in the range of from 0.60 wt. % to 1.4 wt. % Si. In one embodiment, a new aluminum alloy includes at least 0.65 wt. % silicon. In one embodiment, a new aluminum alloy includes not greater than 1.35 wt. % silicon. In another embodiment, a new aluminum alloy includes not greater than 1.3 wt. % silicon.

As noted above, the new aluminum alloys generally include magnesium and in the range of from 0.25 to 0.90 wt. % Mg. In one embodiment, a new aluminum alloy includes at least 0.30 wt. % Mg. In another embodiment, a new aluminum alloy includes at least 0.35 wt. % Mg. In yet another embodiment, a new aluminum alloy includes at least 0.40 wt. % Mg. In another embodiment, a new aluminum alloy includes at least 0.45 wt. % Mg.

As noted above, the new aluminum alloys generally have a ratio of wt. % Si to wt. % Mg of from 1.05:1 to 5.0:1 (Si:Mg). In one embodiment, the ratio of wt. % Si to wt. % Mg is from 1.05:1 to 4.67:1. In another embodiment, the ratio of wt. % Si to wt. % Mg is from 1.05:1 to 4.0:1. In yet another embodiment, the ratio of wt. % Si to wt. % Mg is from 1.05:1 to 3.5:1. In another embodiment, the ratio of wt. % Si to wt. % Mg is from 1.05:1 to 3.1:1. In one embodiment, the ratio of wt. % Si to wt. % Mg is not greater than 2.75:1. In another embodiment, the ratio of wt. % Si to wt. % Mg is not greater than 2.5:1. In one embodiment, the ratio of wt. % Si to wt. % Mg is at least 1.10:1. In another embodiment, the ratio of wt. % Si to wt. % Mg is at least 1.25:1. In yet another embodiment, the ratio of wt. % Si to wt. % Mg is at least 1.50:1. In another embodiment, the ratio of wt. % Si to wt. % Mg is at least 1.75:1.

As noted above, the new aluminum alloys generally include from 0.25 to 2.0 wt. % Cu. In one embodiment, a new aluminum alloy includes an amount of copper sufficient such that an aluminum alloy product realizes a pitting only rating, or "P" rating, when tested in accordance with ASTM G110. In one embodiment, a new aluminum alloy includes an amount of copper sufficient such that an aluminum alloy product realizes a maximum depth of attack of not greater than 500 micrometers when tested in accordance with ASTM G110. In another embodiment, a new aluminum alloy includes an amount of copper sufficient such that an aluminum alloy product realizes a maximum depth of attack of not greater than 250 micrometers when tested in accordance with ASTM G110. In one embodiment, a new aluminum alloy includes at least 0.30 wt. % Cu. In another embodiment, a new aluminum alloy includes at least 0.50 wt. % Cu. In yet another embodiment, a new aluminum alloy includes at least 0.75 wt. % Cu. In yet another embodiment, a new aluminum alloy includes at least 1.0 wt. % Cu. In one embodiment, a new aluminum alloy includes not greater than 1.75 wt. % Cu. In another embodiment, a new aluminum alloy includes not greater than 1.5 wt. % Cu.

As noted above, the new aluminum alloys generally include from 0.10 to 3.5 wt. % Zn. Zinc may be used for solid solution strengthening. In one embodiment, a new aluminum alloy includes an amount of zinc sufficient such that an aluminum alloy product realizes a pitting only rating, or "P" rating, when tested in accordance with ASTM G110. In one embodiment, a new aluminum alloy includes an amount of zinc sufficient such that an aluminum alloy product realizes a maximum depth of attack of not greater than 500 micrometers when tested in accordance with ASTM G110. In another embodiment, a new aluminum alloy includes an amount of zinc sufficient such that an aluminum alloy product realizes a maximum depth of attack of not greater than 250 micrometers when tested in accordance with ASTM G110. In one embodiment, a new aluminum alloy includes at least 0.20 wt. % Zn. In another embodiment, a new aluminum alloy includes at least 0.30 wt. % Zn. In yet another embodiment, a new aluminum alloy includes at least 0.50 wt. % Zn. In one embodiment, a new aluminum alloy includes not greater than 3.0 wt. % Zn. In another embodiment, a new aluminum alloy includes not greater than 2.5 wt. % Zn.

As noted above, the new aluminum alloys generally include from 0.01 to 1.0 wt. % Fe. Iron may help facilitate the appropriate amounts and/or types of intermetallic particles of the aluminum alloy. In one embodiment, a new aluminum alloy includes at least 0.03 wt. % Fe. In another embodiment, a new aluminum alloy includes at least 0.06 wt. % Fe. In yet another embodiment, a new aluminum alloy includes at least 0.09 wt. % Fe. In another embodiment, a new aluminum alloy includes at least 0.12 wt. % Fe. In yet another embodiment, a new aluminum alloy includes at least 0.15 wt. % Fe. In one embodiment, a new aluminum alloy includes not greater than 0.75 wt. % Fe. In another embodiment, a new aluminum alloy includes not greater than 0.60 wt. % Fe. In yet another embodiment, a new aluminum alloy includes not greater than 0.50 wt. % Fe. In another embodiment, a new aluminum alloy includes not greater than 0.40 wt. % Fe. In yet another embodiment, a new aluminum alloy includes not greater than 0.30 wt. % Fe. In another embodiment, a new aluminum alloy includes not greater than 0.25 wt. % Fe. In yet another embodiment, a new aluminum alloy includes not greater than 0.22 wt. % Fe.

As noted above, the new aluminum alloys may include up to 0.80 wt. % Mn. In one embodiment, a new aluminum alloy includes at least 0.05 wt. % Mn. In another embodiment, a new aluminum alloy includes at least 0.08 wt. % Mn. In yet another embodiment, a new aluminum alloy includes at least 0.10 wt. % Mn. In one embodiment, a new aluminum alloy includes not greater than 0.70 wt. % Mn. In another embodiment, a new aluminum alloy includes not greater than 0.60 wt. % Mn. In yet another embodiment, a new aluminum alloy includes not greater than 0.50 wt. % Mn. In another embodiment, a new aluminum alloy includes not greater than 0.40 wt. % Mn. In yet another embodiment, a new aluminum alloy includes not greater than 0.30 wt. % Mn. In another embodiment, a new aluminum alloy includes not greater than 0.25 wt. % Mn. In yet another embodiment, a new aluminum alloy includes not greater than 0.20 wt. % Mn. In another embodiment, a new aluminum alloy includes not greater than 0.18 wt. % Mn.

As noted above, the new aluminum alloys may include up to 0.25 wt. % Cr. In one embodiment, a new aluminum alloy includes at least 0.05 wt. % Cr. In another embodiment, a new aluminum alloy includes at least 0.08 wt. % Cr. In yet another embodiment, a new aluminum alloy includes at least 0.12 wt. % Cr. In another embodiment, a new aluminum alloy includes at least 0.15 wt. % Cr. In yet another embodiment, a new aluminum alloy includes at least 0.18 wt. % Cr. In one embodiment, a new aluminum alloys includes not greater than 0.22 wt. % Cr.

As noted above, the new aluminum alloys may include up to 0.20 wt. % Zr. In one embodiment, a new aluminum alloy includes not greater than 0.05 wt. % Zr. In another embodiment, a new aluminum alloy includes not greater than 0.03 wt. % Zr. In yet another embodiment, in new aluminum alloy includes not greater than 0.01 wt. % Zr.

As noted above, the new aluminum alloys may include up to 0.20 wt. % V. In one embodiment, a new aluminum alloy includes not greater than 0.05 wt. % V. In another embodiment, a new aluminum alloy includes not greater than 0.03 wt. % V. In yet another embodiment, a new aluminum alloy includes not greater than 0.01 wt. % V.

As noted above, the new aluminum alloys may include up to 0.15 wt. % Ti. In one embodiment, a new aluminum alloy includes at least 0.01 wt. % Ti. In another embodiment, a new aluminum alloy includes at least 0.02 wt. % Ti.

As noted above, the new aluminum alloys generally include a total of Fe+Mn+Cr+Zr+V+Ti of not greater than 2.0 wt. %. In one embodiment, a new aluminum alloy includes a total of Fe+Mn+Cr+Zr+V+Ti of not greater than 1.75 wt. %. In another embodiment, a new aluminum alloy includes a total of Fe+Mn+Cr+Zr+V+Ti of not greater than 1.50 wt. %. In yet another embodiment, a new aluminum alloy includes a total of Fe+Mn+Cr+Zr+V+Ti of not greater than 1.25 wt. %. In another embodiment, a new aluminum alloy includes a total of Fe+Mn+Cr+Zr+V+Ti of not greater than 1.0 wt. %. In one embodiment, a new aluminum alloy includes a total of Fe+Mn+Cr+Zr+V+Ti of not greater than 0.8 wt. %. In another embodiment, a new aluminum alloy includes a total of Fe+Mn+Cr+Zr+V+Ti of not greater than 0.65 wt. %.

As noted above, the new aluminum alloys generally include at least some Q phase precipitates (Al—Cu—Mg—Si style precipitates, such as Al5Cu2Mg8Si6), and the solvus temperature of these Q phase precipitates is not greater than 950° F. In one embodiment, the Q phase precipitates realize a solvus temperature of not greater than 925° C. In another embodiment, the Q phase precipitates realize a solvus temperature of not greater than 900° F. In yet another embodiment, the Q phase precipitates realize a solvus temperature of not greater than 875° F. In another embodiment, the Q phase precipitates realize a solvus temperature of not greater than 850° F. In yet another embodiment, the Q phase precipitates realize a solvus temperature of not greater than 825° F.

In addition to the Q phase precipitates, the new aluminum alloys may include $Mg_2Si$ precipitates. When a new aluminum alloy includes $Mg_2Si$ precipitates, generally the volumetric ratio of $Mg_2Si$ precipitates to Q phase precipitates is not greater than 1.25:1 ($Mg_2Si$:Q phase). In one embodiment, the volumetric ratio of $Mg_2Si$ precipitates to Q phase precipitates is not greater than 1.10:1. In another embodiment, the volumetric ratio of $Mg_2Si$ precipitates to Q phase precipitates is not greater than 1.05:1. In yet another embodiment, the volumetric ratio of $Mg_2Si$ precipitates to Q phase precipitates is not greater than 1.0:1. In yet another embodiment, the volumetric ratio of $Mg_2Si$ precipitates to Q phase precipitates is less than 1:0:1. In another embodiment, the volumetric ratio of $Mg_2Si$ precipitates to Q phase precipitates is not greater than 0.95:1. In any of these embodiments the $Mg_2Si$ precipitates may realize a solvus temperature of not greater than 950° F.

In one embodiment, a new aluminum alloy is essentially free of $Al_2Cu$ precipitates. In one embodiment, a new aluminum alloy is essentially free of $Mg_2Si$ precipitates. In one embodiment, a new aluminum alloy is essentially free of both $Al_2Cu$ precipitates and $Mg_2Si$ precipitates.

II. Processing

As noted above, the new aluminum alloy may be processed to any wrought product form, including sheet, plate, forgings, or extrusions. The new aluminum alloy may also be shape cast, or may be used in additive manufacturing to produce an additively manufactured product. Additive manufacturing is defined in ASTM F2792-12a.

In one approach, a new aluminum alloy is made into a press-quenched product/is processed by press-quenching. As noted above, press-quenching generally involves hot working a heat-treatable aluminum alloy into an intermediate or final product form, after which the method is free of any subsequent solution heat treatment. For purposes of this patent application, press-quenching includes isothermal forging.

in one embodiment, and referring now to FIG. 1, a method may comprise (a) preparing a new aluminum alloy for press-quenching (100), then (b) press-quenching the new aluminum alloy (200), thereby producing a press-quenched aluminum alloy product, and then (c) aging the press-quenched aluminum alloy product (300). In these embodiments of FIG. 1, after the press-quenching step (b), the method is absent of any solution heat treatment step. Cold working (400) may optionally be completed after the press quenching step (200).

Regarding the preparing for press-quenching step (100), the method may include the steps of (i) producing an ingot or billet of the new aluminum alloy and (ii) homogenizing the ingot or billet. The homogenization can include one or multiple soak temperatures. The preparing step (100) may also include some hot working and/or cold working, in some circumstances.

Regarding the press-quenching step (200), the method may include (i) working (210) (e.g. hot working) of the aluminum alloy (e.g., in the form of an ingot, a billet, or a prior worked product) into an intermediate or final product form, and (ii) after the working step, quenching the product form with a fluid (220), thereby producing a press-quenched aluminum alloy product. Regarding the working step (b)(i), the working may include using one or more workpieces (e.g., dies, molds, or rolls) to form the aluminum alloy into the product form. In one embodiment, the working step (210) produces the final product form (e.g., when no cold working (400) is applied after the press-quenching step (200)), and thus, after, the press-quenching (200), the press-quenched product is a final press-quenched product. In another embodiment, the working step (210) produces an intermediate product form (e.g., when cold working (400) is applied after the press-quenching step (200)), and thus, after, the press-quenching (200), the press-quenched product is an intermediate press-quenched product.

In one embodiment, prior to the working step (210), a starting working temperature of the aluminum alloy is above the solvus temperature of precipitates phases of the aluminum alloy. In another embodiment, prior to the working, a starting working temperature of the aluminum alloy is not greater than 1075° F., or not greater than 1050° F., or not greater than 1025° F., or not greater than 1000° F., or not greater than 975° F. In one embodiment, prior to the working, a starting working temperature of the aluminum alloy is both (I) above the solvus temperature of precipitates phases of the aluminum alloy, and (II) not greater than 1075° F., or not greater than 1050° F., or 1025° F., or not greater than 1000° F., or not greater than 975° F. After the working step, an ending working temperature of the product form (i.e., the temperature of the product immediately upon conclusion of the working step (210)) may be (I) above the solvus temperature of the precipitates phases of the aluminum alloy, or (II) below the solvus temperature of the precipitate phases but within 100° F. of the solvus temperature of the precipitates phases of the aluminum alloy. In one embodiment, the working comprises extruding. In another embodiment, the working comprises forging. In one embodiment, the working comprises rotary forging. In one embodiment, the working comprises rolling. In one embodiment, the working comprises isothermally working (e.g., isothermally forging). In another embodiment, the working comprises non-isothermally working.

Regarding the quenching step (220), the quenching may comprise cooling the product form from the working temperature to below 600° F. and at a quench rate of at least 5° F. per second. In one embodiment, the quench rate is at least 10° F. per second. In another embodiment, the quench rate is at least 20° F. per second. In yet another embodiment, the quench rate is at least 50° F. per second. In another embodiment, the quench rate is at least 100° F. per second.

The quenching (220) generally comprises contacting the worked product with a quenching medium. The quenching medium may be any suitable gas, liquid, or combination thereof. In one embodiment, the quenching medium comprises a liquid. In one embodiment, the quenching medium comprises a gas. In one embodiment, the quenching medium is air. In one embodiment, the quenching comprises at least one of: (I) immersion of the product form in a liquid and (II) spraying of the product form with a liquid (e.g., spraying of water) or gas (e.g., blowing of air).

Regarding the aging step (300), the aging may include naturally aging to a substantially stable condition (per ANSI H35.1) or artificially aging the press-quenched aluminum alloy product. The artificial aging may comprise single step aging processes or multiple step aging processes. The artificial aging may be underaging, peak aging (e.g., within 2 ksi of peak strength), or overaging.

Products that are press-quenched and then only naturally aged are generally in a T1 temper. Products that are press-quenched and then only artificially aged are generally in a T5 temper. Products that are press-quenched, and then cold worked and then naturally aged are in a T2 temper. Products that are press-quenched, and then cold worked and then artificially aged are in a T10 temper. The new aluminum alloys described herein may be produced in any of a T1, T2 T5 or T10 temper. Thus, in some embodiments, the press-quenched aluminum alloy product is in one of a T1, T2, T5 or T10 temper, as per ANSI H35.1 (2009).

In one embodiment, the aging (300) is natural aging to a substantially stable condition, as per ANSI H35.1 (2009). In one embodiment, the aging (300) comprises artificial aging. In one embodiment, the method is absent of any cold working step (400) after the press-quenching step (b). In another embodiment, cold working (400) is performed after the press-quenching step (b), i.e., the product is in either a T2 or a T10 temper, as per ANSI H35.1 (2009). The cold working may reduce the thickness of the press-quenched product by any appropriate amount, such as by cold working to achieve a reduction in thickness of from 10-75%. In one embodiment, the cold working (400) achieves a reduction in thickness of from 10-50%. The cold working (400) may be accomplished by one or more of rolling, extruding, forging, drawing, ironing, spinning, flow-forming, and combinations thereof, among other types of cold working methods.

The new aluminum alloys may also be made without press-quenching. In one embodiment, a new aluminum alloy is made into one of a T3, T4, T6, T7, T8 or T9 temper, as per ANSI H35.1. For instance, and with reference now to FIG. 2, a method may include (a) preparing a new aluminum alloy for solution heat treatment (500), (b) solution heat treating the aluminum alloy (600), and (c) aging the aluminum alloy (300). Cold working (400) may optionally be completed after the solution heat treating step (600).

The preparing step (500) may is generally similar to the preparing step (100) of FIG. 1, and may include producing an ingot or billet of the new aluminum alloy and then homogenizing the ingot or billet (510). The homogenization (510) can include one or multiple soak temperatures. The preparing step (500) generally includes working (520) of the ingot or billet into an intermediate or final product form. The working (520) generally includes hot working, optionally with cold working. Annealing may optionally be used after any cold working step, but annealing is often not required. Any annealing occurs before the solution heat treating (600).

After the preparing step (500), the worked aluminum alloy product is generally solution heat treated (600). The solution heat treatment (600) may include heating the worked aluminum alloy product to one or more suitable soak temperatures, generally above the solvus temperature, holding at this/these temperature(s) long enough to allow soluble elements to enter into solid solution, and then cooling rapidly enough to hold the elements in solid solution. The heating may be accomplished, for example, via a suitable furnace. No working is completed during the solution heat treating step (600). The subsequent quenching may be completed, for instance, by exposure to an appropriate quenching medium, such as by immersion, spraying and/or jet drying, among other techniques, as described above relative to press-quenching step (200)

After the solution heat treating (600), the aluminum alloy product may be naturally aged or artificially aged (300), and as described above relative to FIG. 1.

For products to be produced in the T4 temper, the solution heat treated product is naturally aged, but without further working (i.e., no hot working or cold working is completed after the solution heat treatment), or artificially aging.

For products to be produced in the T6 or T7 temper, the solution heat treated product is artificially aged after solution heat treatment and without any further working (i.e., no hot working or cold working is completed after the solution heat treatment or after the artificial aging).

For products to be produced in the T9 temper, the solution heat treated product is first artificially aged and then cold worked (not show in FIG. 2).

For products to be produced in the T3 temper, the aluminum alloy product is cold worked after solution heat treatment, and then naturally aged (but not artificially aged).

For products to be produced in the T8 temper, the aluminum alloy product is cold worked after solution heat treatment, and then artificially aged.

For the T3 and T8 temper products, the post-solution heat treatment working generally results in the aluminum alloy product being in its final form/final gauge prior to the natural or artificial aging. For the T9 temper products, the post-artificial aging working results in the aluminum alloy product being in its final form/final gauge.

For shape castings and additively manufactured products, the preparing step (500) is optional, i.e., such products may only include the solution heat treating (600) and aging (300) steps. However, shape castings and additively manufactured products can also be worked, if useful, and such working can be completed pre-solution heat treatment, post-solution heat treatment, or both. Shape castings and additively manufactured products can also be press-quenched, if useful. For purposes of this patent application, shape castings also includes products made by semi-solid metal casting processes, such as squeeze casting.

III. Applications

As noted above, the new aluminum alloys may be produced in wrought form, such as an in rolled form (e.g., as sheet or plate), as an extrusion, or as a forging, among others. The new aluminum alloy may also be in the form of a shape cast product or an additively manufactured product. Such wrought, shape-cast, or additively manufactured products may be used in a variety of applications. In one embodiment, a new aluminum alloy product is in the form of a wheel product (e.g., shape-cast or forged wheel product or a press-quenched forged wheel product). In one embodiment, a forged wheel product is a die-forged wheel product. In one embodiment, a wheel product is a commercial truck wheel product (e.g., for light, medium or heavy-duty applications for trucks, buses or trailers). In one embodiment, a new aluminum alloy product is used as an automotive component, such as a closure panel, a body-in-white (BIW) structure (e.g., A, B or C pillars), a drive-shaft, or a suspension component, among others. In one embodiment, the automotive component is an energy absorbing component (e.g., a bumper, a shock tower). Pipe, fuel cylinders and core barrels (drill pipe), for instance, may also be produced from the new aluminum alloys. Other known product applications for aluminum alloys may also be employed.

DETAILED DESCRIPTION

Example 1

Figure 1:
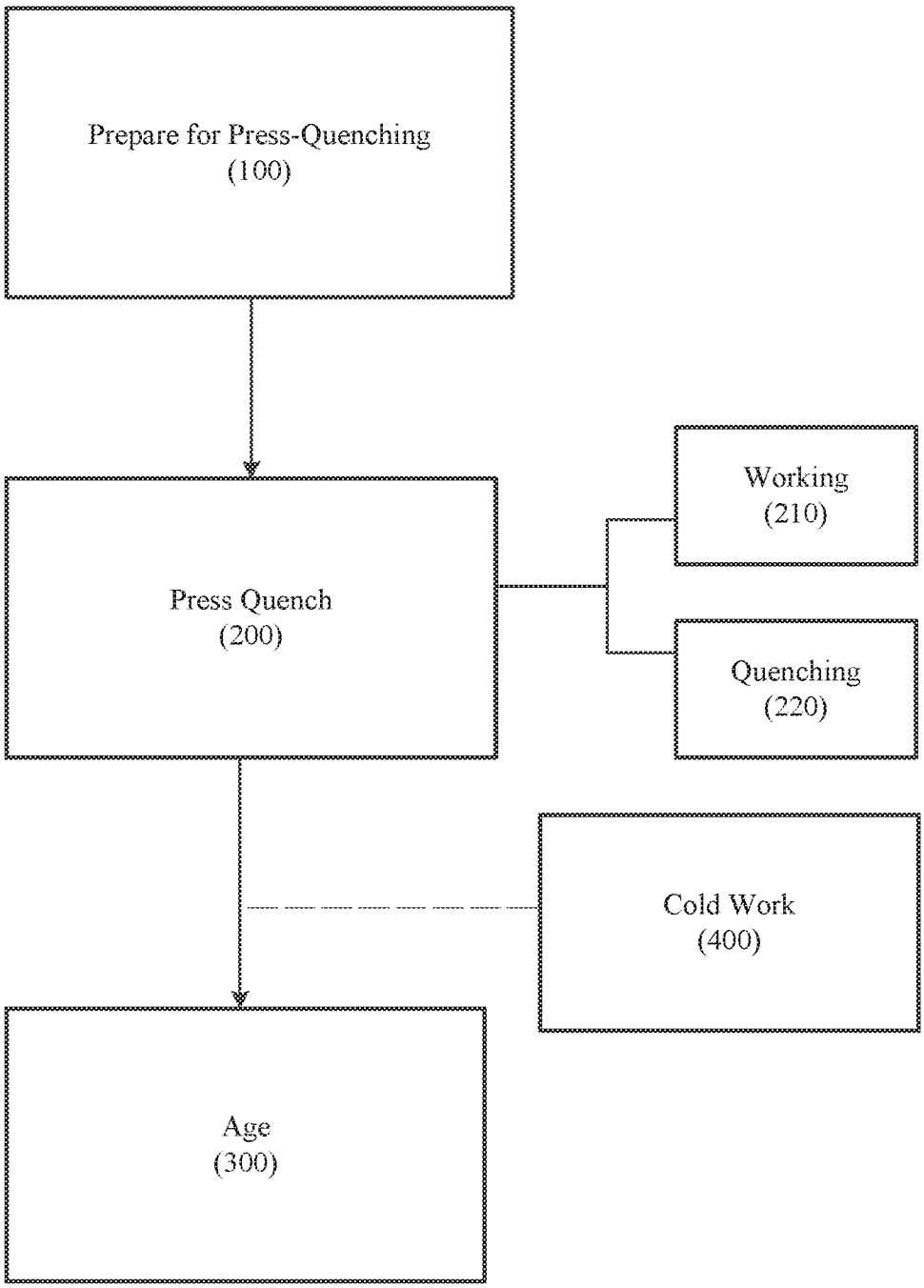
FIG. 1 is a flow chart illustrating various methods for producing press-quenched aluminum alloy products
Figure 2:
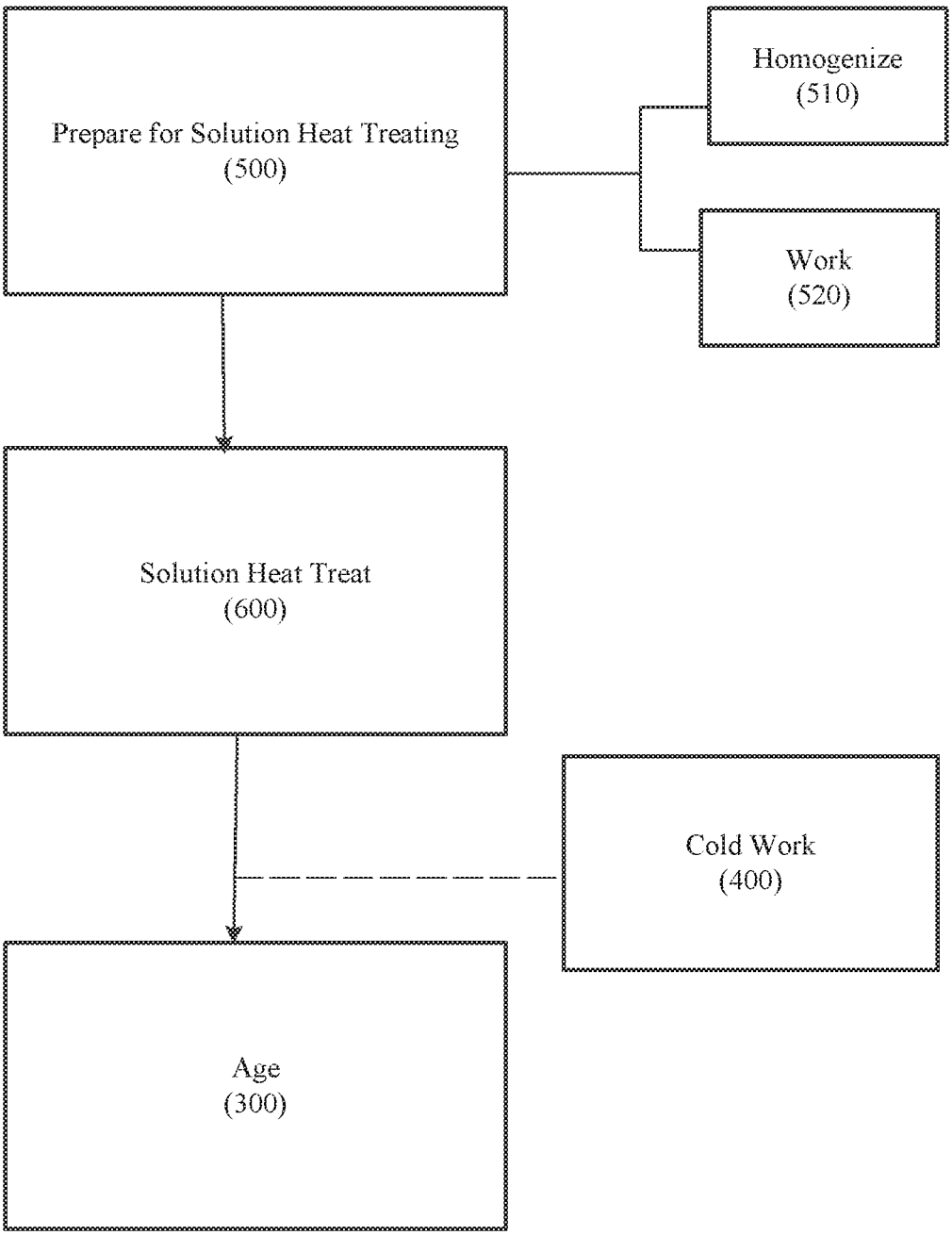
FIG. 2 is a flow chart illustrating various method for producing solution heat treated aluminum alloy products.

Fourteen alloys were modeled using PANDAT thermodynamic modeling software. The compositions of the fourteen alloys are given in Table 1, below. Alloy 1-7 are invention alloys. The other alloys are conventional aluminum alloys.

TABLE 1

Composition of Modeled Alloys (in wt. %)

| Alloy | Si | Mg | Cu | Zn | Fe | Mn | Cr | Si:Mg | Si + Mg |
|---|---|---|---|---|---|---|---|---|---|
| 1 | 0.9 | 0.48 | 0.6 | 0.72 | 0.2 | 0.15 | 0.2 | 1.88:1 | 1.38 |
| 2 | 0.9 | 0.48 | 0.6 | 3.0 | 0.2 | 0.15 | 0.2 | 1.88:1 | 1.38 |
| 3 | 0.7 | 0.61 | 0.6 | 2.0 | 0.15 | 0.1 | 0 | 1.15:1 | 1.31 |
| 4 | 1.3 | 0.61 | 0.6 | 2.0 | 0.15 | 0.1 | 0 | 2.13:1 | 1.91 |
| 5 | 0.9 | 0.48 | 0.9 | 1.0 | 0.2 | 0.15 | 0.2 | 1.88:1 | 1.38 |
| 6 | 0.9 | 0.48 | 0.3 | 2.0 | 0.2 | 0.15 | 0.2 | 1.88:1 | 1.38 |
| 7 | 0.8 | 0.7 | 0.9 | 2.0 | 0.2 | 0.15 | 0.2 | 1.14:1 | 1.5 |
| 8 | 1.1 | 0.55 | 1.2 | 0.5 | 0.2 | 0.14 | 0.2 | 2.0:1 | 1.65 |
| 9 | 1.1 | 0.55 | 1.5 | 0.2 | 0.2 | 0.14 | 0.2 | 2.0:1 | 1.65 |
| 10 | 1.1 | 0.55 | 1.8 | 0.2 | 0.2 | 0.14 | 0.2 | 2.0:1 | 1.65 |
| 6061 | 0.69 | 0.9 | 0.9 | 0 | 0.2 | 0.075 | 0.2 | 0.77:1 | 1.59 |
| 6361 | 0.75 | 1.2 | 1.2 | 0 | 0.15 | 0.14 | 0.24 | 0.63:1 | 1.95 |
| 6056 | 1.0 | 0.9 | 0.9 | 0.4 | 0.25 | 0.7 | 0.25 | 1.11:1 | 1.9 |
| 6156 | 1.0 | 0.95 | 0.95 | 0.4 | 0.15 | 0.55 | 0.25 | 1.05:1 | 1.95 |
| 6013 | 0.75 | 0.95 | 0.95 | 0 | 0.15 | 0.35 | 0.08 | 0.79:1 | 1.7 |
| 6055 | 0.9 | 0.9 | 0.9 | 0.72 | 0.1 | 0.08 | 0.24 | 1:1 | 1.8 |
| 6099 | 1.0 | 0.95 | 0.95 | 0.8 | 0.15 | 0.25 | 0.2 | 1.05:1 | 1.95 |

Table 2, below, includes the modeled thermodynamic properties of the alloys.

TABLE 2

Thermodynamic Properties of Modeled Alloys

| Alloy | Liquidus (° F.) | Solidus (° F.) | $Mg_2Si$ Solvus (° F.) | Q-phase solvus (° F.) | Amount of precipitates at 390° F. (mol. %) | Precipitate Phases |
|---|---|---|---|---|---|---|
| 1 | 1202 | 1084 | 877 | 811 | 1.63 | Q + Si |
| 2 | 1194 | 1055 | 870 | 818 | 1.68 | Q + Si |
| 3 | 1197 | 1078 | 933 | 815 | 1.86 | Q + Si |
| 4 | 1191 | 1014 | 918 | 839 | 2.44 | Q + Si |
| 5 | 1199 | 1070 | — | 884 | 1.64 | Q + Si |
| 6 | 1199 | 1078 | 871 | 734 | 1.61 | Q + Si + $Mg_2Si$ |
| 7 | 1197 | 1066 | 950 | 822 | 1.88 | Q + $Mg_2Si$ |
| 8 | 1197 | 1044 | — | 913 | 1.98 | Q + Si |
| 9 | 1197 | 1037 | — | 924 | 2.78 | Q + Si + Al2Cu |
| 10 | 1195 | 1025 | — | 935 | 3.18 | Q + Al2Cu |
| 6061 | 1204 | 1105 | 964 | — | 1.79 | $Mg_2Si$ + $Al_2Cu$ |
| 6361 | 1212 | 1080 | 1010 | — | 2.36 | $Mg_2Si$ + $Al_2Cu$ |
| 6056 | 1210 | 1050 | 1005 | 865 | 2.65 | Q + $Mg_2Si$ |
| 6156 | 1210 | 1046 | 1005 | 879 | 2.5 | Q + $Mg_2Si$ |
| 6013 | 1199 | 1071 | 996 | 829 | 2.75 | $Mg_2Si$ + $Al_2Cu$ + Q |
| 6055 | 1207 | 1053 | 1000 | 851 | 2.32 | Q + $Mg_2Si$ |
| 6099 | 1200 | 1064 | 1015 | 781 | 2.33 | Q + $Mg_2Si$ |

As shown, the inventive alloys realize Q phase precipitates and these precipitates have low solvus temperatures, indicating applicability to press-quenching. Further, many are free of $Al_2Cu$ and $Mg_2Si$ precipitates.

While various embodiments of the new technology described herein have been described in detail, it is apparent that modifications and adaptations of those embodiments will occur to those skilled in the art. However, it is to be expressly understood that such modifications and adaptations are within the spirit and scope of the presently disclosed technology.

What is claimed is:

1. An aluminum alloy comprising:

0.6-1.4 wt. % Si;

0.25-0.90 wt. % Mg;

wherein the ratio of wt. % Si to wt. % Mg is from 1.05:1 to 5.0:1;

0.25-2.0 wt. % Cu;

0.10-3.5 wt. % Zn;

0.01-1.0 wt. % Fe;

up to 0.8 wt. % Mn;

up to 0.25 wt. % Cr;

up to 0.20 wt. % Zr;

up to 0.20 wt. % V;

up to 0.15 wt. % Ti;

wherein the total of Fe+Mn+Cr+Zr+V+Ti is not greater than 2.0 wt. %;

the balance being aluminum and impurities;

wherein the aluminum alloy includes Q phase precipitates; and wherein the solvus temperature of the Q phase precipitates and any $Mg_2Si$ precipitates is not greater than 950° F.

2. The aluminum alloy of claim 1, wherein the aluminum alloy includes at least 0.7 wt. % Si.

3. The aluminum alloy of claim 2, wherein the aluminum alloy includes not greater than 1.3 wt. % Si.

4. The aluminum alloy of claim 1, wherein the aluminum alloy includes at least 0.30 wt. % Mg, and wherein the ratio of wt. % Si to wt. % Mg is from 1.05:1 to 4.67:1.

5. The aluminum alloy of claim 4, wherein the ratio of wt. % Si to wt. % Mg is at least 1.10:1.

6. The aluminum alloy of claim 5, wherein the ratio of wt. % Si to wt. % Mg is not greater than 2.75:1, or not greater than 2.5:1.

7. The aluminum alloy of claim 1, wherein the aluminum alloy includes at least 0.30 wt. % Cu.

8. The aluminum alloy of claim 7, wherein the aluminum alloy includes not greater than 1.75 wt. % Cu.

9. The aluminum alloy of claim 1, wherein the aluminum alloy includes at least 0.20 wt. % Zn.

10. The aluminum alloy of claim 9, wherein the aluminum alloy includes not greater than 3.0 wt. % Zn.

11. The aluminum alloy of claim 1, wherein the aluminum alloy includes from 0.10 to 0.30 wt. % Mn.

12. The aluminum alloy claim 11, wherein the aluminum alloy includes not greater than 0.05 wt. % Zr and not greater than 0.05 wt. % V.

13. The aluminum alloy of claim 1, wherein the aluminum alloy includes the Q phase precipitates and $Mg_2Si$ precipitates, and a volumetric ratio of $Mg_2Si$ precipitates to Q phase precipitates is not greater than 1.25:1 (($Mg_2Si$(vol.)):(Q phase (vol.)).

* * * * *